United States Patent [19]

Saigo et al.

[11] Patent Number: 4,516,951

[45] Date of Patent: May 14, 1985

[54] MOVABLE TOY ANIMAL

[75] Inventors: Hiroshi Saigo, Kasukabe; Hiroshi Kaneko, Tokyo, both of Japan

[73] Assignee: Iwaya Corporation, Tokyo, Japan

[21] Appl. No.: 553,848

[22] Filed: Nov. 21, 1983

[30] Foreign Application Priority Data

Nov. 29, 1982 [JP] Japan ..... 57-208972

[51] Int. Cl.[3] ..... A63H 3/36

[52] U.S. Cl. ..... 446/338; 446/330; 446/353; 446/371; 446/376

[58] Field of Search ..... 446/330, 335, 336, 337, 446/338, 352, 353, 354, 356, 376

[56] References Cited

U.S. PATENT DOCUMENTS

| | | | |
|---|---|---|---|
| 1,782,477 | 11/1930 | Price | 446/338 X |
| 3,383,795 | 5/1968 | Ryan et al. | 446/337 X |
| 3,672,096 | 6/1972 | Johmann | 446/338 |
| 3,851,418 | 12/1974 | Barlow et al. | 446/354 X |
| 3,858,352 | 1/1975 | Cummings et al. | 446/338 X |
| 3,964,205 | 6/1976 | Kuramochi | 446/338 |
| 4,073,088 | 2/1978 | Beny et al. | 446/354 |
| 4,245,515 | 1/1981 | Iwaya | 446/356 X |

FOREIGN PATENT DOCUMENTS

| | | | |
|---|---|---|---|
| 2089225 | 6/1982 | United Kingdom | 446/353 |

*Primary Examiner*—Robert A. Hafer
*Assistant Examiner*—D. N. Muir
*Attorney, Agent, or Firm*—James E. Nilles

[57] ABSTRACT

A movable toy animal wherein an electric motor is set on a frame in a head and electrically connected to a battery in a trunk, gearing is operatively connected to the electric motor, an axially-movable change-over gear is meshed with a first output gear in the gearing and adapted to be engaged with and disengaged from a nose-driving gear, which is adapted to move a nose forward and backward and mounted fixedly on a crankshaft, a driving shaft having an input gear is meshed with a second output gear in the gearing, a cam disc is mounted fixedly on the driving shaft, the cam disc having on its inner side surface a projection adapted to urge a pressure-receiving portion of a slide shaft, on which the change-over gear is fixedly mounted, first and second cam plates of different shapes is mounted fixedly on both end portions of the driving shaft and connected operatively to operating members, which are adapted to move ears up and down, and a switch unit is provided in a rear portion of a head so as to constitute a part thereof, and which has a push element provided retractably and adapted to be pressed to actuate the electric motor.

3 Claims, 16 Drawing Figures

MOVABLE TOY ANIMAL

BACKGROUND OF THE INVENTION

1. Field of the Invention

This invention relates to a movable toy animal made by modifying the form of an ear-carried animal, such as a rabbit, a mouse and a squirrel and adapted to make predetermined actions.

2. Description of the Prior Art

Various kinds of movable toy animals manufactured by imitating the form of animals have been proposed. Many of conventional movable toy animals are adapted to walk, cry while moving the head up and down, or shake the tail.

A body of such a conventional movable toy animal is enclosed entirely with a covering material, so that it has an appearance of an animal. However, in practice, the covering material is merely put on a hard frame, which contains a driving mechanism therein. Accordingly, the toy animal is unpleasant to touch when it is picked up, and it does not feel like an animal.

When an animal toy employs an electric motor as a driving power source for making various actions, a switch is provided in an exposed state on a certain portion of an outer surface of a toy body. This would spoil an external appearance of the toy animal.

The mouths of many conventional movable toy animals are so formed as to be opened and closed simply at the same time that they cry. The ears of such toy animals are attached to the covering materials therein for mere decorative purposes in many cases.

SUMMARY OF THE INVENTION

The present invention has been developed in view of the above-mentioned points. An object of the present invention is to obtain a movable toy animal having a toy body, a grip portion of which feels like a corresponding part of an animal and pleasant, a switch for use in starting actions of the toy body, which switch is formed so as to constitute a part of its head and so as not to be exposed to the outside, and ears adapted to be swung alternately at the same time that the toy animal moves like a real animal chewing food and mumbling on the alert for the surroundings.

The movable toy animal according to the present invention is characterized in that it consists of a toy body composed of a trunk containing a battery case therein and made of a soft and elastic material, a head provided on the trunk and having a face with eyes and a nose thereon and ears attached to both side portions of the head, and a skin covering the trunk and head and covering with hair; an electric motor set on a frame in the head and electrically connected to a battery in the battery case; gearing operatively connected to the electric motor; an axially-movable change-over gear meshed with a first output gear in the gearing and adapted to be engaged with and disengaged from a nose-driving gear, which is adapted to move the nose forward and backward and mounted fixedly on a crankshaft; a driving shaft having an input gear meshed with a second output gear in the gearing; a cam disc mounted fixedly on the driving shaft and having on its inner side surface a projection adapted to urge a pressure-receiving portion of a slide shaft, on which the change-over gear is fixedly mounted; first and second cam plates of different shapes mounted fixedly on both end portions of the driving shaft and connected operatively to operating members, which are adapted to move the ears up and down; and a switch unit, which is provided in a rear portion of the head so as to constitute a part thereof, and which has a push element provided retractably and adapted to be pressed to actuate the electric motor.

The above and other objects as well as advantageous features of the invention will become apparent from the following description of the preferred embodiment taken in conjunction with the accompanying drawings.

FIGSS. 10–15 illustrate operations of the switch unit; and

Figure 16:
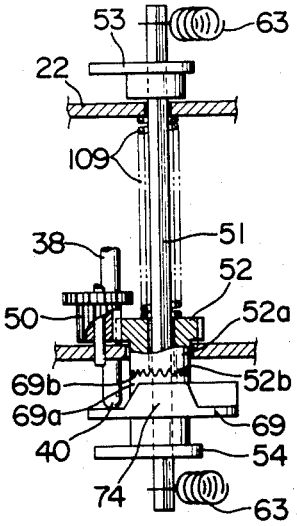

FIG. 16 is a front elevational view of a safety mechanism.

DESCRIPTION OF THE PREFERRED EMBODIMENTS

Referring to the drawings, reference numeral 1 denotes a toy rabbit body made by modifying the form of a real rabbit. This toy body 1 consists of a trunk 2, a head 3, and a covering material 4 covering the trunk 2 and head 3 and covered with hair. The hair-covered covering material 4 includes legs 5, which extend forward from a lower end of the trunk 2, hands 6 extending sideways from opposite sides of an intermediate portion of the trunk 2, ears 7 extending forward from an upper end of the head 3, and a tail 8 extending backward from a lower end portion of the trunk 2, which cause the toy rabbit to feel like a real rabbit. A face 9 of the hair-covered material 4 is provided with eyes 10, a nose 12 in a mouth portion thereof, and a ribbon 13 on a neck portion thereof.

In order that the trunk 2 feels pleasant, it is made of a soft and elastic material 14, such as polyurethane foam. The trunk 2 is formed in such a manner that it swells outward by degrees from an upper end portion to an intermediate portion thereof, in such a manner that the portion of the trunk 2 which is between the intermediate portion and a lower end thereof is formed to a gradually decreasing diameter, i.e. conically. A battery case 15, in which a battery E is housed, is inserted in the central portion of the soft and elastic material 14 in such a manner that the battery case 15 extends in the vertical direction. At a lower open end of the battery case 15, a cover 17 is set on a rest portion 16 of the soft and elastic material 14 via a support frame 18 in such a manner that the cover 17 can be opened and closed. At an upper end portion of the battery case 15, a neck frame 20 is provided so as to project upward via a support plate 19 attached to an upper surface of the soft and elastic material 14.

The head 3 has a two-divided head frame 21, on which a machine frame 22 is set so as to be joined at its lower end portion to an upper end portion of the neck frame 20 via a lateral shaft 23.

An electric motor 24 is fixed in the machine frame 22, and a pinion 26 is mounted fixedly on an output shaft 25 thereof, a reduction gear 27 being meshed with the pinion 26. An interlocking gear 29 is mounted fixedly on an interlocking shaft 28, on which the reduction gear 27 is mounted. A fixed terminal member 30 is provided on one side portion of the electric motor 24 in such a manner that the fixed terminal member 30 extends along a curved surface of the electric motor 24 and is connected electrically thereto. A movable terminal member 31 is connected electrically at its base end portion 32 through the battery E in the battery case 15 to the end portion of the electric motor 24 which is on the opposite side of the base end portion 32. The base end portion 32 of the movable terminal member 31 is fixed to one side portion of the machine frame 22. The movable terminal member 31 has at its lower end section a bent contact portion 33, which is adapted to be engaged with and disengaged from the fixed terminal member 30, and at its intermediate section an outwardly-bent pressure-receiving portion 34.

An input gear 36 in a gearing 35 is meshed with the interlocking gear 29, and a change-over gear 39 on a slide shaft 38, which is supported on the machine frame 22 in such a manner that the slide shaft 38 can be moved slidingly in the lateral direction, with a first output gear 37 in the gearing 35. The slide shaft 38 is provided at its one end section with a sectionally arcuate pressure-receiving portion 40. A coiled spring 41 urging the slide shaft 38 so as to engage the change-over gear 39 with the first output gear 37 constantly is provided between the other end section of the slide shaft 38 and machine frame 22.

A nose-driving gear 42, with and from which the change-over gear 39 is engaged and disengaged, is mounted fixedly on a crankshaft 43 supported horizontally and rotatably on the machine frame 22. A bent interlocking member 45 is mounted pivotably at its one end portion on a crank arm 44 of the crankshaft 43. An L-shaped nose frame 46 is connected pivotably at its bent portion to the other end portion of the interlocking member 45 via a mounting shaft 47. A vertical portion of the nose frame 46 is supported pivotably at its upper end section on a front upper portion of the head frame 21 via a lateral shaft 48. The nose 12 is provided at a front end of a horizontal portion of the nose frame 46 via a recess 49, through which the hair-covered covering material 4 extends, in such a manner that the nose 12 projects frontward.

An input gear 52 on a square pillar type driving shaft 51, which extends laterally to be supported pivotably on the machine frame 22, is meshed with a second output gear 50 in the gearing 35. First and second cam plates 53, 54 are mounted on both end portions of the driving shaft 51. The first cam plate 53 is rhombically formed, and has a rhombic engaging surface 55 on a circumferential edge thereof. The second cam plate 54 is formed in the shape of a mountain having a recess 56 and two projections 57 with an engaging surface 58 formed on circumferential edges thereof.

A support shaft 59 is held on the machine frame 22 so as to extend laterally, and operating members 60 are mounted at one end portion of each thereof on both end portions of the shaft 59 in such a manner that the operating members 60 can be moved up and down. Each of these two operating members 60 is provided at the other end portion thereof with an elongated guide bore 61, which extends in the lengthwise direction of the relative operating member 60. The operating members 60 are further provided at their respective lower edge sections with engaging portions 62, which are adapted to be engaged with the engaging surfaces 55, 58 of the first and second cam plates 53, 54, and which are formed integrally with and extend at an angle to the operating members 60. Coiled springs 63 are provided between the operating members 60 and driving shaft 51 so as to urge the engaging portions 62 into contact with the opposed engaging surfaces 55, 58.

Shafts 65 of interlocking members 64 are inserted pivotably into the elongated guide bores 61 in the two operating members 60. These two interlocking members 64 are joined pivotably to both end portions of a shaft 66 supported horizontally on upper end portions of the machine frame 22. Ear frames 68 bent substantially in the shape of the letter "L" and consisting of coiled springs are joined fixedly at their respective lower end portions to projections 67 provided on upper end portions of the interlocking members 64. These ear frames 68 are inserted into the ears 7.

A cam disc 69 is mounted fixedly on one side portion of the driving shaft 51. The cam disc 69 is provided with a recess 71 in its circumferential engaging surface 70, and an engaging surface 73 on its inner side. The pressure-receiving portion 40 of the slide shaft 38 contacts the engaging surface 73 to be moved slidingly thereon in the circumferential direction of a bearing boss 72. A projection 74, which is adapted to press the pressure-receiving portion 40, is provided on the portion of the cam disc 69 which has the engaging surface 73, so as to extend in the inward direction. The projection 74 is provided at both sides thereof with inclined guide surfaces 75,76 relative to the engaging surface 73.

The machine frame 22 is provided thereon with a switch unit 77, which is adapted to open and close the movable terminal member 31 opposed to the fixed terminal member 30. The switch unit 77 consists of a slide body 78, a change-over member 79, and a lock plate 80.

The slide body 78 is formed in the shape of the letter "C" in plan. Opposite parallel-extending side members 81 of the slide body 78 are provided with elongated guide bores 82 in front and rear portions thereof. One of these side members 81 is provided on its upper edge with a horizontal slide-engaging surface 83, and an inclined disengaging surface 84 at a front end portion of the slide-engaging surface 83, the surfaces 83, 84 being formed continuously. A locking projection 85 is provided on an outer surface of the portion of the mentioned side member 81 which is on the front side of the inclined disengaging surface 84. The locking projection 85 is formed integrally with the side member 81. A sectionally arcuate push element 87 is provided so as to project backward from a rear member 86 formed between and integrally with the side members 81. The push element 87 is housed retractably in a bore 88 formed at a rear portion of the head frame 21. Front and rear guide rods 89, 90 projecting from a rear portion of the machine frame 22 are inserted into the front and rear elongated bores 82 in the opposite side members 81 of the slide body 78. Consequently, the slide body 78 is set in such a manner that it can be moved slidingly in the longitudinal direction thereof with respect to the machine frame 22 via the guide rods 89, 90. A coiled spring 92 is provided between a projection 91, which extends from the rear member 86 of the slide body 78, and machine frame 22. The slide body 78 is urged backward by the coiled spring 92, and the push element 87 is positioned in the bore 88 in the head frame 21 when the toy animal is not in operation.

The change-over member 79 is joined at a portion thereof which is in the vicinity of a lower end thereof to one side portion of the machine frame 22 via a support shaft 93 in such a manner that the change-over member 79 can be moved pivotally in the forward and backward direction. The change-over member 79 is provided at its lower end portion with an inclined engaging surface 94 adapted to be engaged with the slide-engaging surface 83 and inclined disengaging surface 84 of the slide body 78, and at its upper end portion with a locking rod 95 projecting therefrom. The locking rod 95 is adapted to be engaged with and disengaged from the engaging circumferential surface 70 and recess 71 on and in the cam disc 69. When the locking rod 95 is disengaged from the recess 71 to engage the engaging circumferential surface 70, the contact portion 33 of the movable terminal member 31 is brought into press contact with the fixed terminal member 30.

The lock plate 80 is joined pivotably at its rear end portion to one end, which is on the outside of one side member 81 of the slide body 78, of the rear guide rod 90 inserted into the rear guide bore 82 in the same side member 81. The lock plate 80 is provided on the inner side of its front end portion with an inclined lift surface 96 projecting therefrom, with which the locking projection 85 of the slide body 78 is engageable. A guide projection 97 is provided on the front side of and continuously from a lower end of the inclined lift surface 96. A guide passage 99, through which the locking projection 85 passes, is formed between a lower surface of the guide projection 97 and a longitudinally-extending guide member 98 formed at a lower edge of the lock plate 80. A ridge 100, which is adapted to press the locking projection 85 upward, is formed integrally with and at an intermediate portion of the guide member 98. A locking recess 102 is formed on the opposite side of the inclined lift surface 96. The locking recess 102 is defined by the guide projection 97 and a locking projection 101, which is provided above the guide projection 97, and adapted to hold the locking projection 85 therein. The locking projection 101 is provided on its inner side with an inclined guide surface 103 adapted to guide the locking projection 85 being disengaged from the recess 102. A guide member 105 opposed to the locking recess 102 is provided so as to project backward from a front end wall 104 of the lock plate 80. The guide member 98 is provided at its intermediate portion with a cut 106, which is adapted to be engaged with an upper surface of the lateral shaft 23. A spring 107 is wound around the guide rod 90. One end portion of the spring 107 is fastened to the machine frame 22, and the other end portion thereof to a support member 108 of the lock plate 80. The lock plate 80 is urged constantly against the lateral shaft 23 due to the force of the spring 107.

The operation of the movable toy animal having the above-described construction will now be described.

Figure 1:
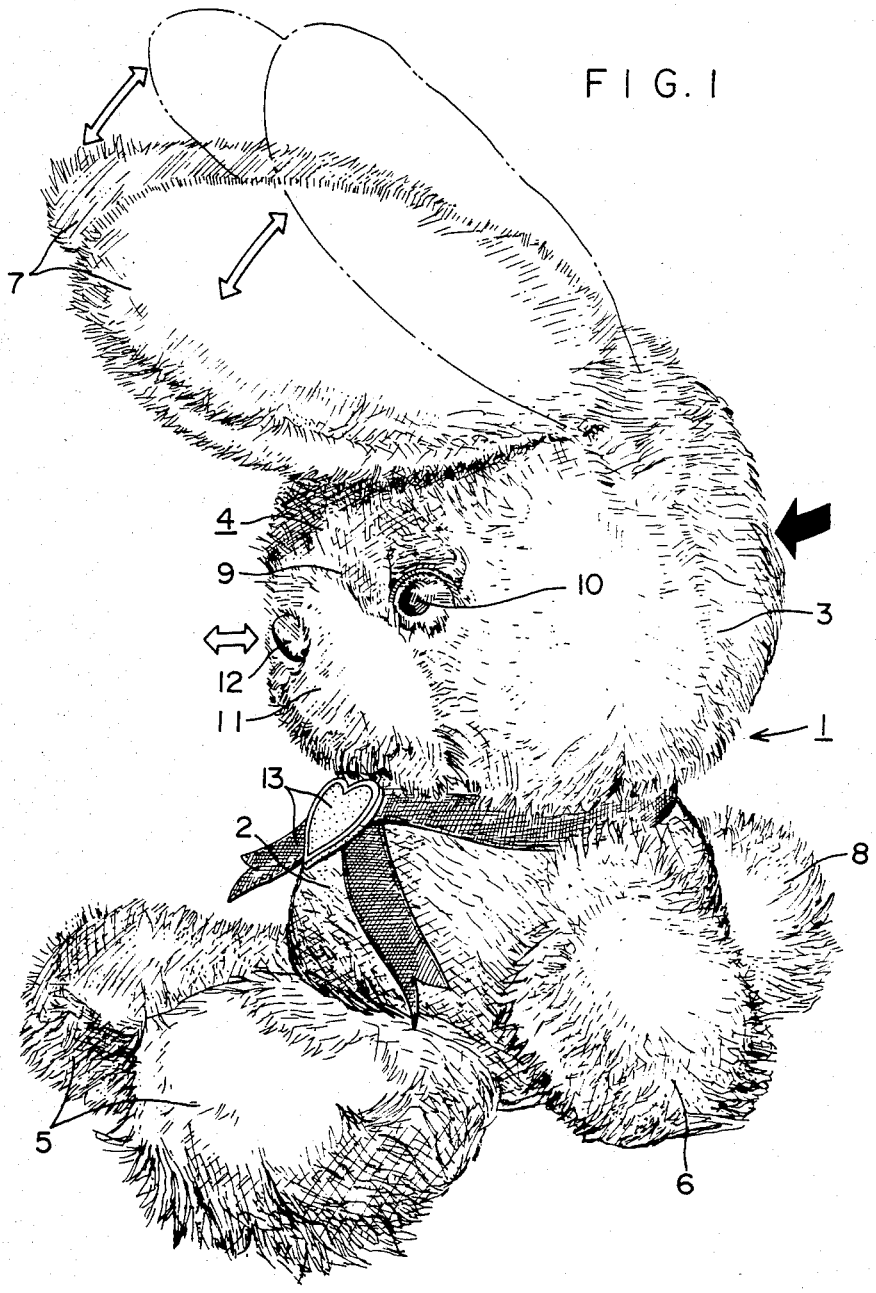
FIG. 1 is a perspective view of a movable toy animal.
Figure 2:
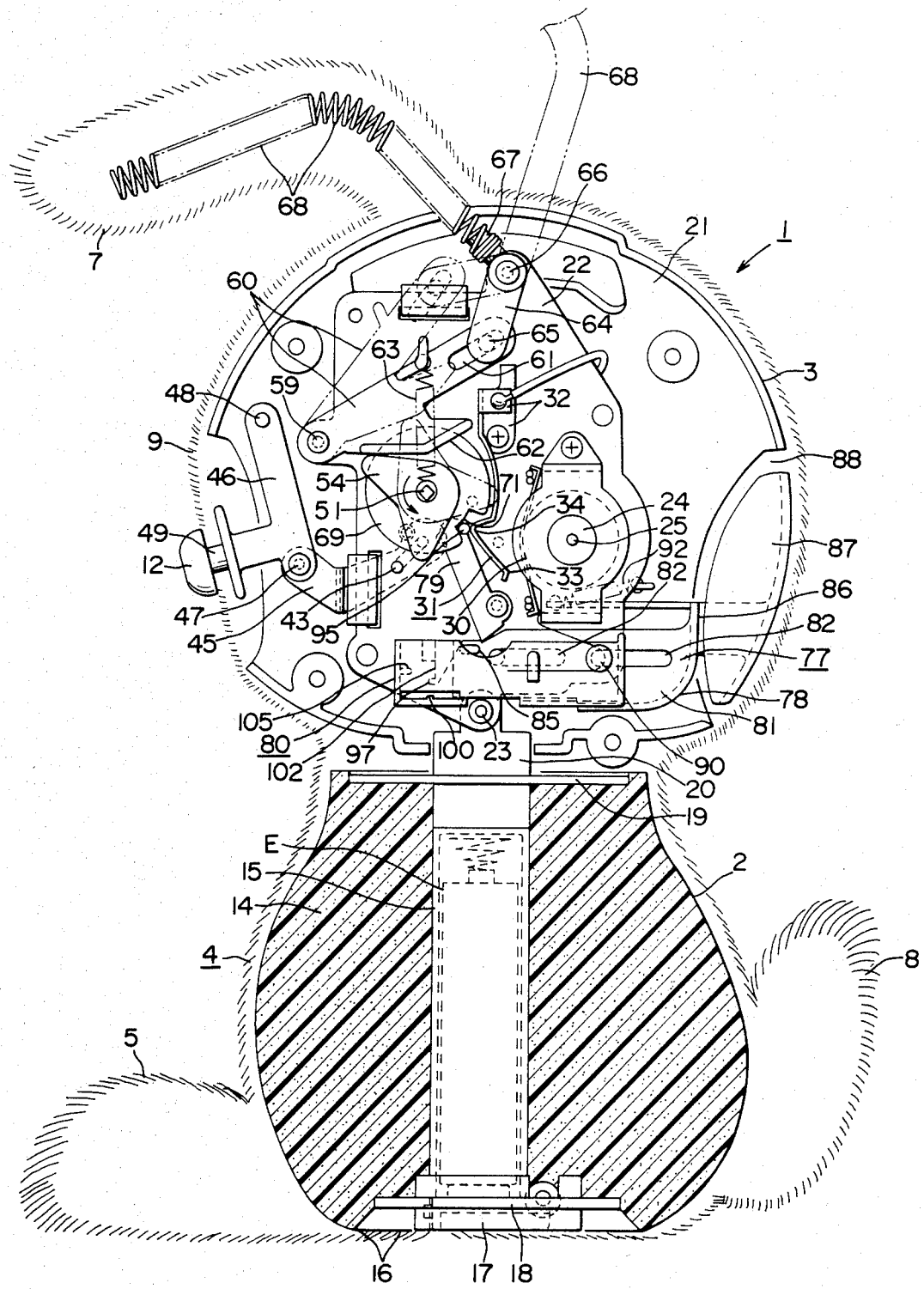
FIG. 2 is a side elevational view in section of the movable toy animal.
Figure 3:
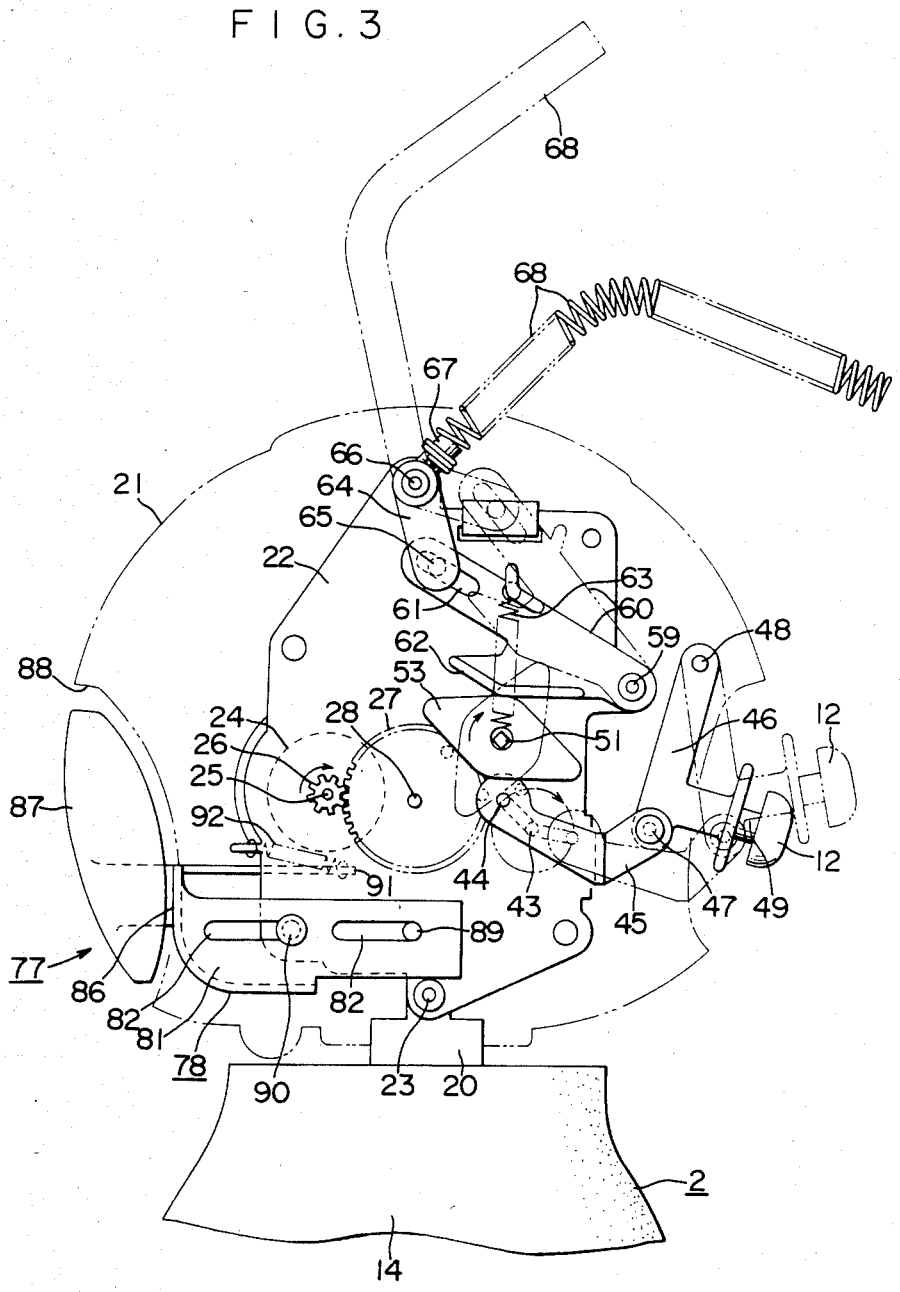
FIG. 3 is another side elevational view in section of a head of the movable toy animal.
Figure 4:
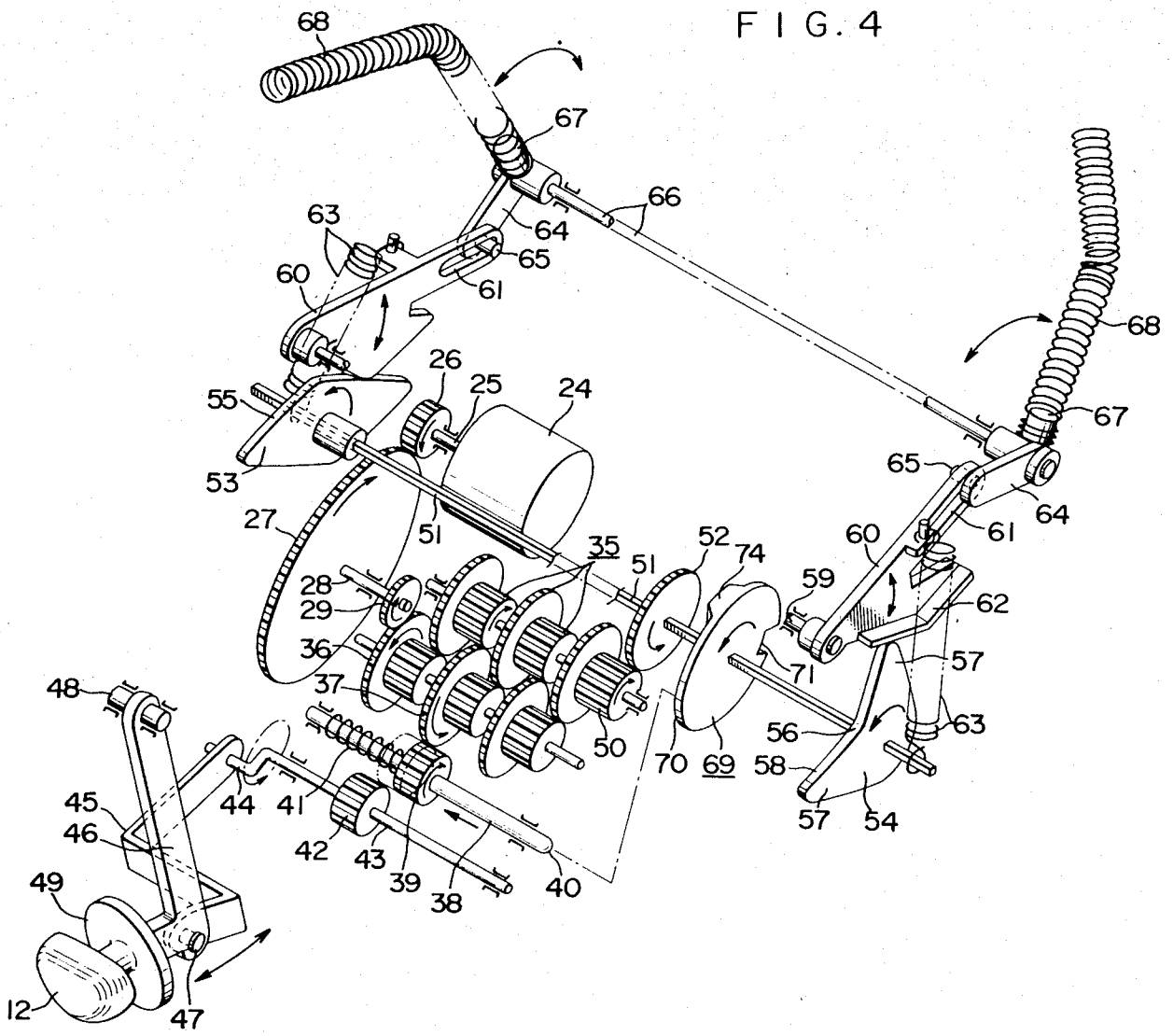
FIG. 4 is a perspective view of a driving mechanism for the movable toy animal.
Figure 5:
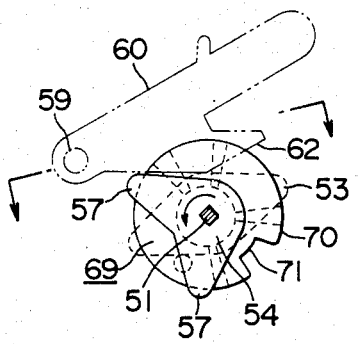
FIG. 5 is a side elevational view of a cam mechanism for the movable toy animal.
Figure 6:
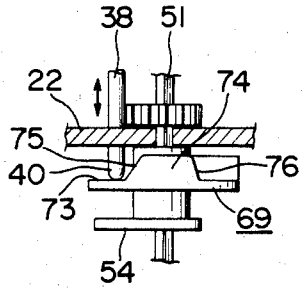
FIG. 6 is a plan view of the cam mechanism.
Figure 7:
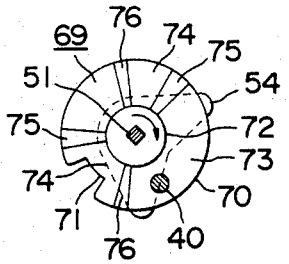
FIG. 7 is a side elevational view of a cam disc in the cam mechanism.
Figure 8:
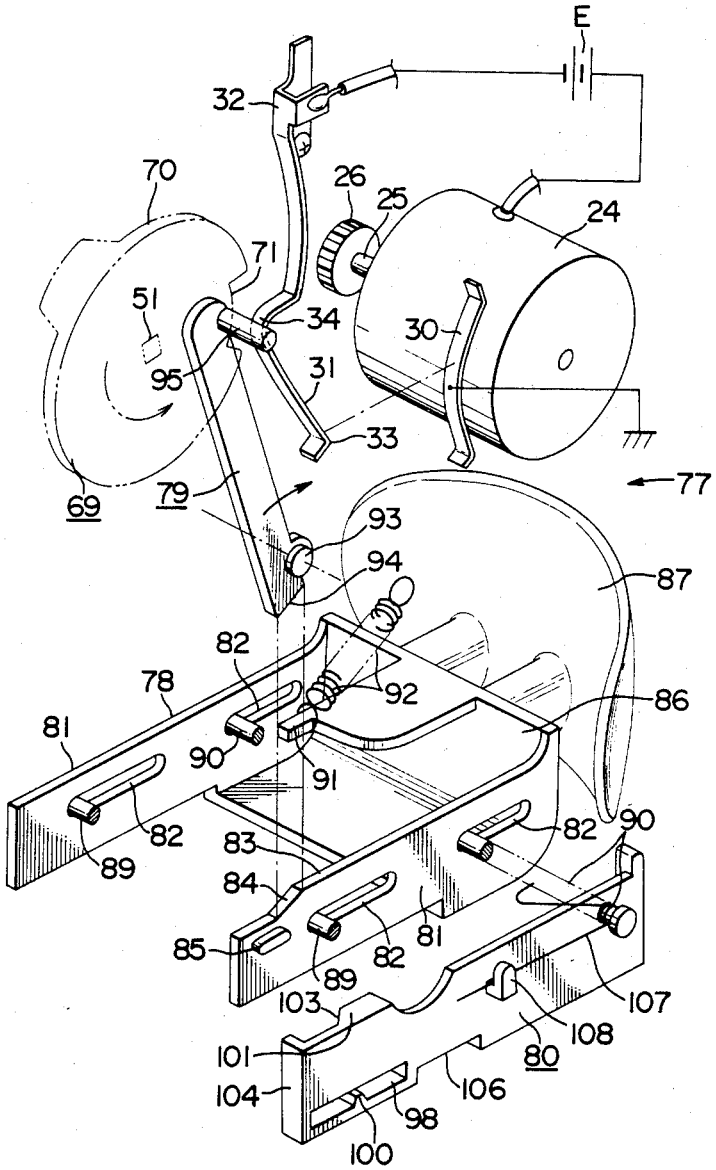
FIG. 8 is an exploded view in perspective of a switch unit for the movable toy animal.
Figure 9:
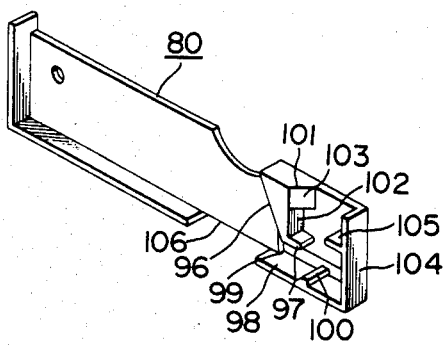
FIG. 9 is a perspective view of a lock member of the switch unit.
Figure 10:
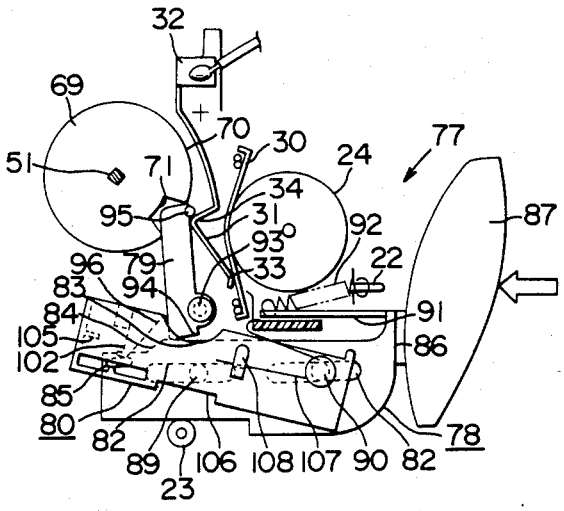

First, when the rear portion of the head 3 of the toy body 1 in a rested state shown in FIG. 1 is pressed with a comparatively low pressure, the push element 87 positioned in the rear portion of the head 3 is moved forward via the hair-covered covering material 4 as shown in FIG. 10. The slide body 78 operatively connected to the push element 87 is moved forward at the same time against the coiled spring 92 as the slide body 78 is guided by the guide rods 89, 90 joined to the machine frame 22.

The slide-engaging surface 83 continuing from the inclined disengaging surface 84 formed on one side member 81 of the slide body 78 then comes into engagement with the inclined engaging surface 94 of the change-over member 79. Due to the forward movement of the slide body 78, the change-over member 79 is turned clockwise by the slide-engaging surface 83 around the support shaft 93 via the inclined engaging surface 94. Owing to the pivotal movement of the change-over member 79, the locking rod 95 at an upper end portion thereof is disengaged from the recess 71 in the cam disc 69 to press the pressure-receiving portion 34 of the movable terminal member 31. As a result, the terminal member 31 is moved against the resiliency thereof, and the contact portion 33 at the lower end section thereof engages the fixed terminal member 30, so that the movable terminal member 31 and fixed terminal member 30 are electrically connected.

During this time, the locking projection 85 of the slide body 78 is moved slidingly from an upper end portion to a lower end portion of the inclined lift surface 96, and the lock plate 80 is lifted against the spring 107 to be turned clockwise around the fulcrum guide rod 90, which is provided at a rear portion of the lock plate 80. Wyhen the locking projection 85 is inserted into the guide passage 99 between the guide projection 97 and guide member 98, upper and lower end portions of front and rear sections of the locking projection 85 is temporarily locked between the guide projection 97 and ridge 100 on the guide member 98.

Figure 11:
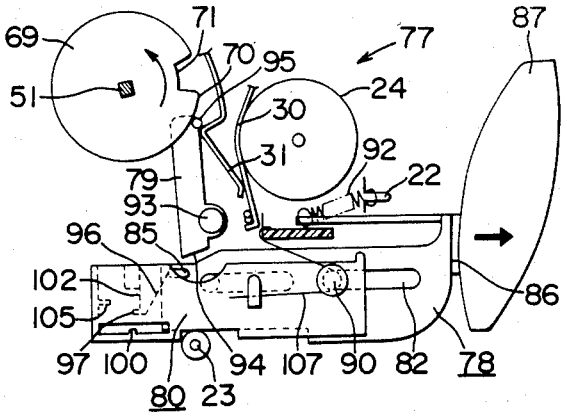

When the push element 87 of the slide body 78 is then released from the pressure, the slide body 78 is slided back forcibly by the resilient force of the coiled spring 92 as shown in FIG. 11, and the push element 87 returns to the interior of the bore 88. In the meantime, the locking projection 85 is disengaged from the guide passage 99 to engage the inclined lift surface 96, so that the lock plate 80 is turned counter-clockwise by the resilient force of the spring 107 around the guide rod 90 provided at a rear portion thereof, to be returned to the original position.

An electric circuit in the switch unit 77 is closed in the above-mentioned manner, the electric motor 24 is started, the gearing 35 is actuated via the pinion 26 on the output shaft 25 of the motor 24, and the reduction gear 27 and interlocking gear 29 on the interlocking shaft 28. Consequently, the driving shaft 51 is driven via the input gear 52 meshed with the second output gear 50 in the gearing 35. The cam disc 69 mounted on the driving shaft 51 is turned counter-clockwise in FIG. 11 after the locking rod 95 on the change-over member 79 has been disengaged from the recess 71. While the cam disc 69 is thus turned, the locking rod 95, which keeps the movable terminal member 31 in contact with the fixed terminal member 30, is held under pressure by the engaging circumferential surface 70 thereof. Accordingly, even when the slide body 78 is moved backward with the engaging circumferential surface 70 engaged with the locking rod 95, so that the slide-engaging surface 83 of one side member 81 of the slide body 78 is moved backward to be disengaged from the inclined engaging surfaces 94 of the change-over member 79 and cause the inclined engaging surface 94 to be opposed to the inclined disengaging surface 84 continuous with the slide-engaging surface 83, the change-over member 79 is not moved pivotally to its original position.

When the driving shaft 51 is actuated as mentioned above, the first and second cam plates 53, 54 mounted fixedly on both end portions thereof are turned, so that the two operating members 60 are moved pivotally in the vertical direction around the support shaft 59 against the coiled springs 63 via the engaging members 62, which are engaged with the engaging surfaces 55, 58 of the cam plates 53, 54. The interlocking members 64 connected to the operating members 60 via the shafts 65 fitted in the elongated guide bores 61 therein are moved pivotally in the vertical direction around the shaft 66. Consequently, the ears 7 of the toy body 1 are moved up and down or forward and backward alternately and irregularly with respect to each other via the ear frames 68 fastened to the interlocking members 64. Namely, the ears 7 of the toy animal are shaken . Since the shapes of the first and second cam plates 53, 54 are different, the ears 7 of the toy body 1 are moved in the above-mentioned manner.

When the cam disc 69 is further turned in accordance with the turning of the driving shaft 51 with the locking rod 95 supported on the engaging circumferential surface 70 thereof, the pressure-receiving portion 40, which slidingly contacts the engaging surface 73 on the inner side of the cam disc 69, of the slide shaft 38 runs on the projection 74 from one inclined guide surface 75, and the slide shaft 38 is slided gradually in its axial direction against the coiled spring 41, so that the change-over gear 39 mounted on an intermediate portion of the slide shaft 38 comes into engagement with the nose-driving gear 42 as the change-over gear 39 is left meshed with the first output gear 37 in the gearing 35. As a result, the crankshaft 43 is turned by the nose-driving gear 42, so that the nose frame 46 is moved forward and backward around the lateral shaft 48 via the interlocking member 45, which is pivotably mounted on the crank arm 44 of the crankshaft 43. Consequently, the nose 12 provided on the nose frame 46 is moved forward and backward with the hair-covered covering material 4, and with respect to the nose 12 the mouth 11 of the toy body 1 is thereby moved forward and backward, so that the toy body 1 moves as if it makes food-chewing actions.

When the cam disc 69 is further turned, the pressure-receiving portion 40 of the slide shaft 38 climbs over the projection 74 to engage the engaging surface 73 via the other inclined guide surface 76, and the slide shaft 38 is moved back due to the resilient force of the coiled spring 41. Consequently, the change-over gear 39 is disengaged from the nose-driving gear 42 to be operatively disconnected therefrom. When the pressure-receiving portion 40 of the slide shaft 38 is then pressed by a subsequent projection 74, the toy body 1 makes the above-described actions. The cam disc 69 is turned continuously to repeat the above actions.

When the cam disc 69 has made one full turn, the recess 71 therein is positioned in opposition to the locking rod 95, which is then moved back into the recess 71 due to the resilient force of the movable terminal member 31. The contact portion 33 of the movable terminal member 31 is disengaged automatically from the fixed terminal member 30 to open the electric circuit in the switch unit 77. As a result, one cycle of operation of the toy body 1, in which the switch is pressed with a comparatively low pressure, is completed automatically to set the toy body 1 ready to make the following actions.

Figure 12:
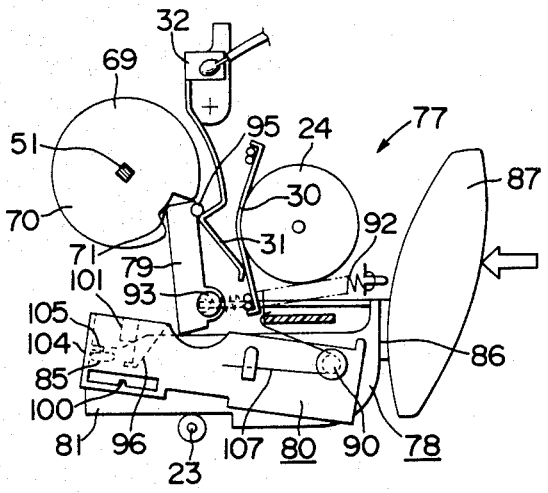
Figure 13:
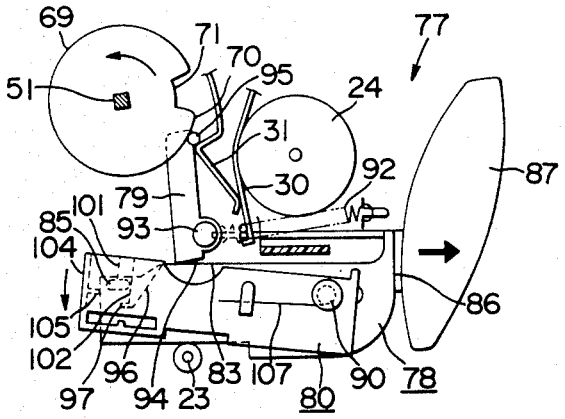

When the push element 87 is pressed with a high pressure, the slide body 78 is moved against the spring 92, and the locking projection 85 causes in the same manner as in the above-described case, the lock plate 80 to be lifted and turned clockwise against the coiled spring 107. The locking projection 85 is moved from the inclined lift surface 96 to the guide passage 99 at once to climb over the ridge 100 and engage the portion of the front end wall 104 of the lock plate 80 which is below the guide member 105, as shown in FIG. 12. Consequently, the lock plate 80 is turned counter-clockwise due to the resilient force of the spring 107. When the push element 87 is then released from the pressure, it is drawn back due to the resilient force of the coiled spring 92. As a result, the locking projection 85 comes into engagement with the locking recess 102 in the lock plate 80 as shown in FIG. 13. Since the lock plate 80 is urged by the spring 107 so as to be turned, a lower surface of the locking projection 101 engages an upper surface of the locking projection 85. Accordingly, the slide body 78 does not return to a rear position automatically.

During this time, the slide-engaging surface 83 formed on one side member 81 of the slide body 78 engages the inclined engaging surface 94 of the change-over member 79. Due to the forward movement of the slide body 78, the change-over member 79 is turned in the same manner as in the previously-described case by the slide-engaging surface 83 via the inclined engaging surface 94. As a result, the locking rod 95 on the change-over member 79 urges the pressure-receiving portion 34 of the movable terminal member 31 to cause the movable terminal member 31 to electrically contact the fixed terminal member 30, and the electric circuit in the switch unit 77 to be closed. The resultant condition is retained until the push element 87 has been pressed with a high pressure again.

The toy body 1 enables such a one-cycle action to be made in continuous repetition.

Figure 14:
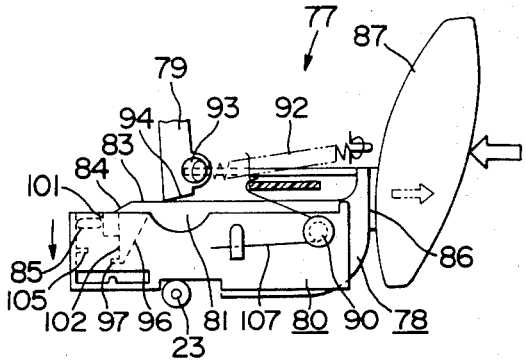
Figure 15:
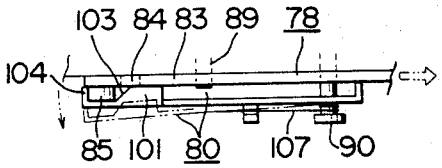

When the push element 87 is then pressed with a high pressure, the slide body 78 is moved forward against the spring 92, and the locking projection 85 at the front end portion of the slide body 78 is disengaged from the locking recess 102 in the lock plate 80 to be positioned above the guide member 105 with the locking projection 101 of the lock plate released at the same time from the locking force of the locking projection 85. At this time, the lock plate 80 is turned counter-clockwise due to the resilient force of the spring 107 as shown in FIG. 14, to be returned to its original position automatically, and the cut 106 engages the upper surface of the lateral shaft 23. The locking projection 85 of the slide body 78 is positioned automatically between an upper portion of the front wall 104 of the lock plate 80 and the locking projection 101 opposed to the mentioned portion of the front wall 104. When the push element 87 in a pressed state is released from the pressure, the slide body 78 is drawn due to the resilient force of the coiled spring 92, and the locking projection 85 is disengaged from the locking projection 101 as the locking projection 85 urges the lock plate 80 slightly in the outward direction along the inclined guide surface 103 formed on the locking projection 101 of the lock plate 80. Namely, the locking projection 85 is disengaged from the locking recess 102 to cause the slide body 78 to be unlocked from the lock plate 80.

Consequently, the slide body 78 is slided backward forcibly due to the force of the coiled spring 92 to be returned to its original position, and the toy body 1 is set ready for subsequent actions thereof. The lock plate 80 is moved back in the inward direction at the same time that the locking projection 85 passes the locking projection 101, to approach one side member 81 of the slide body 78. The locking projection 85 thus returns to a position above the inclined lift surface 96 of the lock plate 80. Also, the slide body 78 is moved slidingly to the original position, while the slide-engaging surface 83 of one side member 81 thereof is moved back to be disengaged from the inclined engaging surface 94 of the change-over member 79. As a result, the inclined engaging surface 94 is positioned in opposition to the inclined disengaging surface 84, which is continuous with the slide-engaging surface 83, so that the change-over member 79 is released from the pressure from the engaging surface 83. When the cam disc 69 is further turned, the recess 71 provided therein is positioned in opposition to the locking rod 95 on the change-over member 79. Since the locking rod 95 has been released from the supporting force of the slide body 78 via the change-over member 79, it is pushed back into the recess 71 due to the resilient force of the movable terminal member 31. The movable terminal member 31 is thus removed automatically from the fixed terminal member 30, so that the electric circuit in the switch unit 77 is opened. The continuous actions of the toy body 1, in which the switch is pressed with a comparatively high pressure, is thus completed automatically. The toy body 1 can then be set ready for making the following actions.

In order to practice the invention, various parts thereof may be arranged as shown in FIG. 16, though a description of the arrangement is omitted in the above embodiment. Namely, the cam disc 69 is mounted fixedly on the driving shaft 51, and the input gear 52 is mounted in such a manner that it can be slided in the axial direction and turned around the driving shaft 51. A sectionally zigzag locking surface **52*b* is formed on an outer end surface of a bearing boss 52*a* of the input gear 52, while a sectionally zigzag locking surface 69*b*, which is meshed with the locking surface 52*b*, is formed on an inner end surface of a bearing boss 69*a* of the cam disc 69. A coiled spring 109 is wound around the portion of the driving shaft 51 which is between an inner end surface of the input gear 52 and the machine frame 22. The input gear 52 is urged by the coiled spring 109 against the cam disc 69 to mesh the locking surface 52*b* of the former with the locking surface 69*b* of the latter to transmit an output from the second output gear 50 in the gearing 35 to the cam disc 69 via the input gear 52**.

When both or one of the ears 7 of the toy animal thus constructed is gripped while the ears 7 are in operation, so that the actions of the ear are prevented, the input gear 52 is turned by the second output gear 50 in the gearing 35 as the input gear 52 is moved forward and backward in the axial direction against the coiled spring 109 by the locking surface **69*b* of the cam disc 69 via the locking surface 52*b*. Therefore, when an ear 7 is gripped to prevent the cam disc 69 from turning, the cam disc 69 is not forcibly turned by the input gear 52. Accordingly, the driving mechanism in the toy body 1** is not broken; it can be kept safe.

EFFECT OF THE INVENTION

According to the present invention, a trunk of a toy body, which contains a battery case therein, is made of a soft, elastic material. In addition, the trunk, at which the toy animal is gripped or embraced, is covered with a hair-covered covering material. Accordingly, the toy animal has a good appearance and is pleasant to touch, so that is looks and feels like a real animal. A push element in a switch unit is provided in a rear portion of a head so as to constitute a part thereof and be connected to another part thereof. Since the push element is also covered with a part of the hair-covered covering material, the switch is not exposed to the outside of the toy body. Accordingly, the toy body has a beautiful external appearance and an increased commercial value. Since the push element in the switch unit is provided at a rear portion of the head, a player can press the same portion of the head against him as the embraces the toy body, to simply close the switch. Therefore, this animal toy can be operated and handled easily. The battery case contained in the trunk constitutes a core of the soft, elastic material. This enables the form of the soft, elastic material to be kept properly, the trunk to be rested stably, and the driving mechanism-containing head to be supported stably. When the switch is closed, an electric motor is started, and a change-over gear meshed with a first output gear in gearing, which is operatively connected to the electric motor, is turned. When the change-over gear is meshed by a cam disc with a nose-driving gear via a slide shaft, a nose is moved forward and backward via a crank shaft, on which the nose-driving gear is mounted. Since the nose is moved forward and backward with the portion of the hair-covered covering material which extends thereover, the toy animal makes food-chewing and mumbling actions. When a driving shaft is turned by a second output gear in the gearing to turn first and second cam plates mounted on both end portions thereof, both ears are moved alternately in the vertical direction via operating members. Since the first and second cam plates are formed in different shapes, the ears are moved up and down irregularly in an alternate manner. Therefore, the toy body shakes its ears alternately in different directions and moves its mouth like an animal chewing the food and mumbles on the alert for the surroundings. Thus, the movable toy according to the present invention can be made by modifying the form of a small animal, for example, a rabbit and adapting it to make various actions. In fact, a toy animal capable of making various actions reliably can be obtained. Therefore, the movable toy animal according to the present invention is very much interesting and capable of heightening the people's will to purchase the same.

What is claimed is:

1. A movable toy animal comprising a toy body consisting of a trunk containing a battery case therein and made of a soft, elastic material, a head provided on said trunk and having a face with eyes and a nose thereon and ears attached to both side portions of said head, and a skin covering said trunk and said head and covered with hair; an electric motor set on a frame in said head and electrically connected to a battery in said battery case; gearing operatively connected to said electric motor; an axially-movable change-over gear meshed with a first output gear in said gearing and adapted to be engaged with and disengaged from a nose-driving gear, which is adapted to move said nose forward and backward and mounted fixedly on a crankshaft; a driving shaft having an input gear meshed with a second output gear in said gearing; a cam disc mounted fixedly on said driving shaft and having on its inner side surface a projection adated to urge a pressure-receiving portion of a slide shaft, on which said change-over gear is fixedly mounted; first and second cam plates of different shapes mounted fixedly on both end portions of said driving shaft and connected operatively to operating members, which are adapted to move said ears up and down; and a switch unit, which is provided in a rear portion of said head so as to constitute a part thereof, and which has a push element provided retractably and adapted to be pressed to actuate said electric motor.

2. A movable toy animal according to claim 1, wherein said switch unit consists of a pivotable change-over member having a locking rod adapted to open and close a contact of said electric motor; a slide body capable of being moved slidingly in its longitudinal direction and having a slide-engaging surface for pivotally moving said change-over member, and a push element; and a pivotable lock plate adapted to lock said slide body in a predetermined position.

3. A movable toy animal according to claim 1 or 2, wherein said cam disc has an engaging circumferential surface for urging said locking rod on said change-over member so as to close said contact of said electric motor, and a recess for releasing said locking rod from the urging force of said engaging circumferential surface so as to open said contact of said electric motor.

* * * * *